US006327881B1

(12) United States Patent
Gründler et al.

(10) Patent No.: US 6,327,881 B1
(45) Date of Patent: Dec. 11, 2001

(54) LOCKING DEVICE

(75) Inventors: Daniel Gründler, Leonberg; Udo Dieners, Besigheim/Ottmarsheim, both of (DE)

(73) Assignee: Gretsch-Unitas GmbH Baubeschlage, Ditzingen (DE)

( * ) Notice: Subject to any disclaimer, the term of this patent is extended or adjusted under 35 U.S.C. 154(b) by 0 days.

(21) Appl. No.: 09/178,490

(22) Filed: Oct. 26, 1998

(30) Foreign Application Priority Data

Oct. 24, 1997 (DE) ..... 297 18 982 U

(51) Int. Cl.[7] ..... E05B 59/04; E05B 63/14

(52) U.S. Cl. ..... 70/107; 70/109; 70/110; 292/167; 292/169.14

(58) Field of Search ..... 70/109, 110, 107, 70/108; 292/167, 169.14, DIG. 24

(56) References Cited

U.S. PATENT DOCUMENTS

| | | | | |
|---|---|---|---|---|
| 512,022 | * | 1/1894 | Gower, Jr. | 70/118 |
| 536,957 | * | 4/1895 | Klein | 70/109 |
| 780,181 | * | 1/1905 | Holden | 70/118 |
| 1,706,486 | * | 3/1929 | Gasey | 292/167 X |
| 5,495,731 | * | 3/1996 | Riznik | 70/108 |
| 5,782,114 | * | 7/1998 | Zeus et al. | 70/109 |

FOREIGN PATENT DOCUMENTS

| | | | | |
|---|---|---|---|---|
| 3505379 | * | 10/1986 | (DE) . | |
| 3836694 | * | 5/1990 | (DE) | 70/107 |
| 0798436A2 | * | 10/1997 | (EP) . | |
| 2540170 | * | 8/1984 | (FR) | 70/109 |
| 4862 | * | 11/1823 | (GB) | 70/110 |

* cited by examiner

*Primary Examiner*—Lloyd A. Gall
(74) *Attorney, Agent, or Firm*—Jones, Tullar & Cooper, P.C.

(57) ABSTRACT

A locking device for a door, window, or the like, has a main lock casing, at least one additional lock casing and at least one pushrod connecting the additional lock casing with the main lock casing. The additional lock casing has a retractable latch bolt, which can be freely pushed out of the latch position into the additional lock casing, which can be pushed into its locking position by means of a spring and/or a gear. The latch bolt on its side located opposite a leading incline and in the area of the latch end has a protrusion, on which a latch restoring lever acts, and the latch restoring lever has a first catch, by means of which a pushrod is taken along in the, and; one direction, a second catch, by means of which it is taken along by the pushrod in the other.

6 Claims, 3 Drawing Sheets

11
2
19
21
8
20
18
16
6
17
15
14
13
12
9
7
51
4
50
49
11

FIG. 3
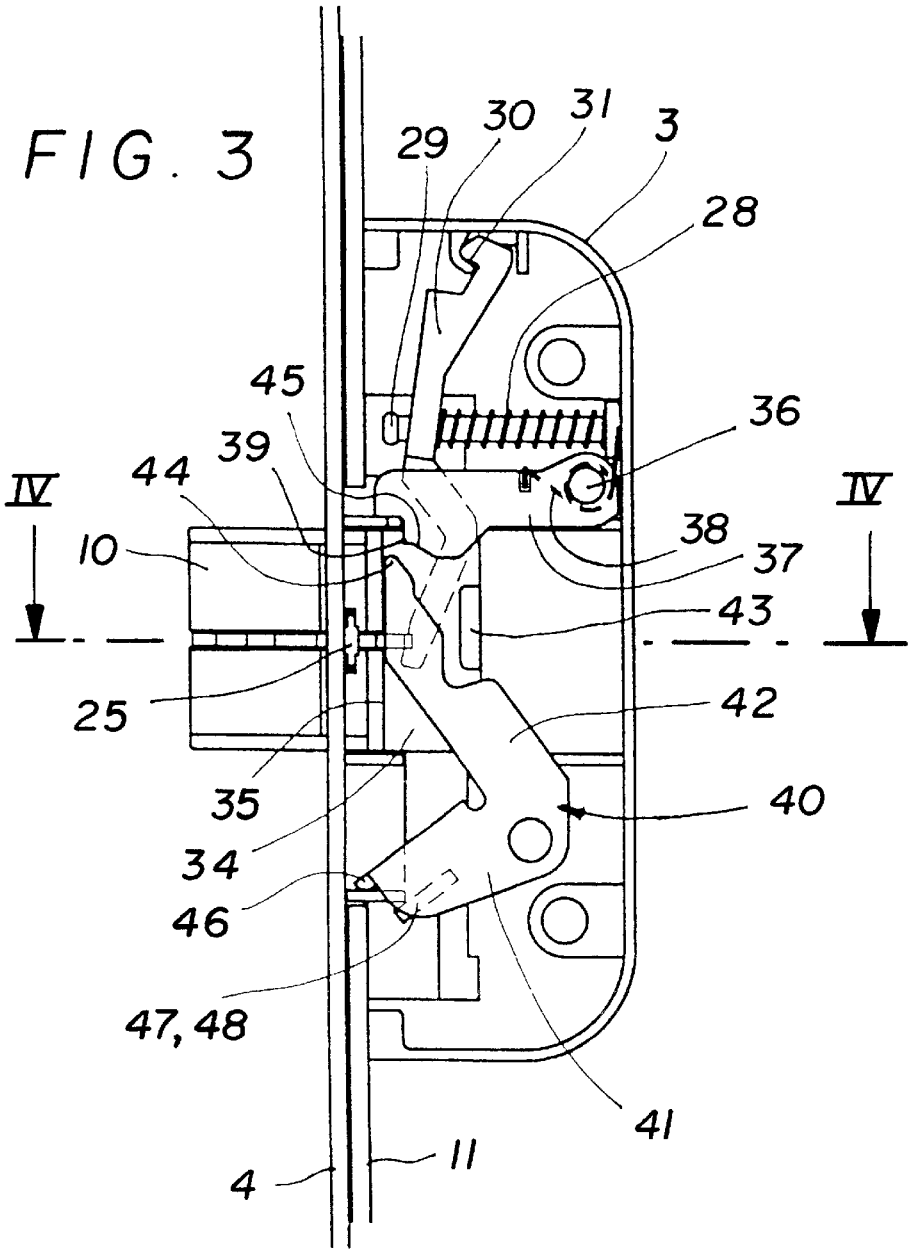
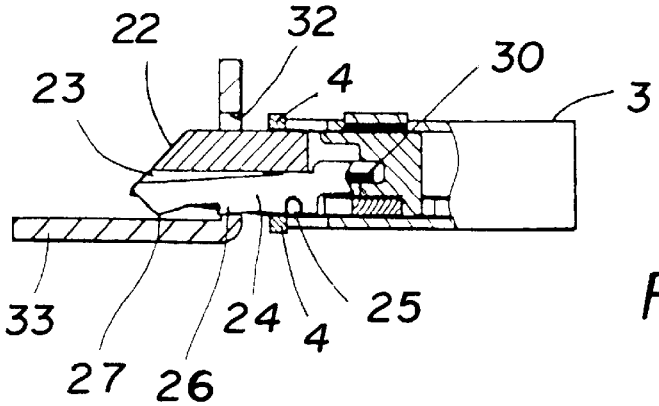
FIG. 4

LOCKING DEVICE

FIELD OF THE INVENTION

The present invention relates to a locking device for a door, window, or the like, with a main lock casing, at least one additional lock casing and at least one pushrod connecting the additional lock casing with the main lock casing. The additional lock casing has a freely retractable latch bolt, which can be pushed past the normal latch position into its locking position by means of a spring and/or a gear, and which on its side located opposite a leading incline and in the area of the latch end has a protrusion on which a latch restoring lever acts. The latch restoring lever has a first catch, by means of which a pushrod is taken along in the one direction.

BACKGROUND OF THE INVENTION

A pushrod lock is known from DE 35 05 379 C1. The lock connected via a pushrod with a center lock. This pushrod therefore connects the elements of the two locks. In this way it is possible to connect a door with the locking plate on the door frame not only in the center, but also in the area of its corners. In the process of closing the door, the latches are pushed in via the locking plate, so that the door can take up its locked position. For opening the door, the latch of the center lock is actuated by means of a latch key or a lock cylinder and retracted, wherein the movement is transferred to the latch of the pushrod lock via the pushrod, so that this latch is also retracted. It is disadvantageous in this connection that the pushrod is always also activated in the course of the insertion movement of the latch. This leads to stiff movements of the latch and malfunctions.

A mortise lock with a latch bolt is known from EP 431 369 A2. Besides the job of a conventional bolt, this latch bolt has the job of additionally locking the door, which is accomplished in that after closing the door the latch bolt changes automatically from a latch position into a lock position, in which it is extended away farther from the mortise lock than in the latch position and because of this extends deeply into the locking plate in the door frame. As a rule, such a latch bolt can no longer be pushed back by the insertion of a tool in the slit between the door and the door frame. A door with such a latch bolt is automatically locked after closing.

A locking device of the type mentioned at the outset is also known from DE 296 05 517 U1 wherein, however, there is the danger that in case of a warped door the spring-loaded latch bolt of the additional lock casing possibly no longer completely enters into the locking plate of the door panel frame and instead is jammed against the locking plate.

SUMMARY OF THE INVENTION

The present invention has as an object making available a locking device with additional lock casings by means of which the door offers improved resistance to break-ins and further, that the locking function is dependably performed.

In accordance with the present invention, this object is attained in that in connection with locking devices of the type mentioned at the outset, the latch restoring lever has a second catch, by means of which it is taken along in the other direction by the pushrod.

By means of the locking device in accordance with the present invention the advantage is attained, that the door can be held and also locked via the latch bolt outside of the center, i.e. at least in the area of a corner. In the course of locking a door equipped with the locking device in accordance with the present invention, first the latch bolt is pushed back via the locking plate on the side of the door frame, as a result of which closing of the door is made possible. Once the door is in the closed position, the latch bolt is pushed out of the additional lock casing and assumes a locking position past its latched position. In this position the latch bolt can no longer be pushed back, for example by the insertion of a flat tool into the gap between the door and the door frame. A door locked in this way offers great resistance to break-in. By means of the second catch it is assured that the latch bolt is inevitably extended with a downward movement of the pushrod, which is caused by locking the main lock by means of keys. If the latch bolt should become jammed against the locking plate of the door panel frame, this is either noted when actuating the key, so that the door can be correctly locked, or the jamming effect is overcome by the locking movement of the key and the latch bolt is locked shut.

In accordance with an exemplary embodiment it is provided that the second catch is formed by an element extending from the latch restoring lever. which is bent, at preferably a right angle from the latch restoring lever Such a component can be produced simply and at reasonable cost. Furthermore, existing latch restoring levers can be easily exchanged for the latch restoring lever of the present invention.

Another exemplary embodiment provides that the second catch comprises a welded-on element. The latch restoring levers in accordance with the present invention can also be produced at reasonable cost and simply.

In a variant in accordance with the present invention, the push-out stroke of the latch bolt is caused in that the main lock bolt has an extension, which acts on the pushrod during locking. The pushrod is displaced by the extension, so that the latch bolt is extended by means of the latch bolt restoring lever even against possible small resistance.

Further advantages, characteristics and details ensue from the claims as well as from the description which follows, wherein particularly preferred exemplary embodiments are represented in detail, making reference to the drawings. Here, the characteristics represented in the drawings and mentioned in the specification and the claims can be essential for the present invention respectively by themselves or in any arbitrary combination.

BRIEF DESCRIPTION OF THE DRAWINGS

FIG. 3, is a plan view of the additional lock casing with the casing cover removed, wherein the latch bolt is in the locked position; and FIG. 4, a section taken along line, IV—IV in accordance with FIG. 3 through the latch bolt.

DESCRIPTION OF THE PREFERRED EMBODIMENTS

Figure 1:
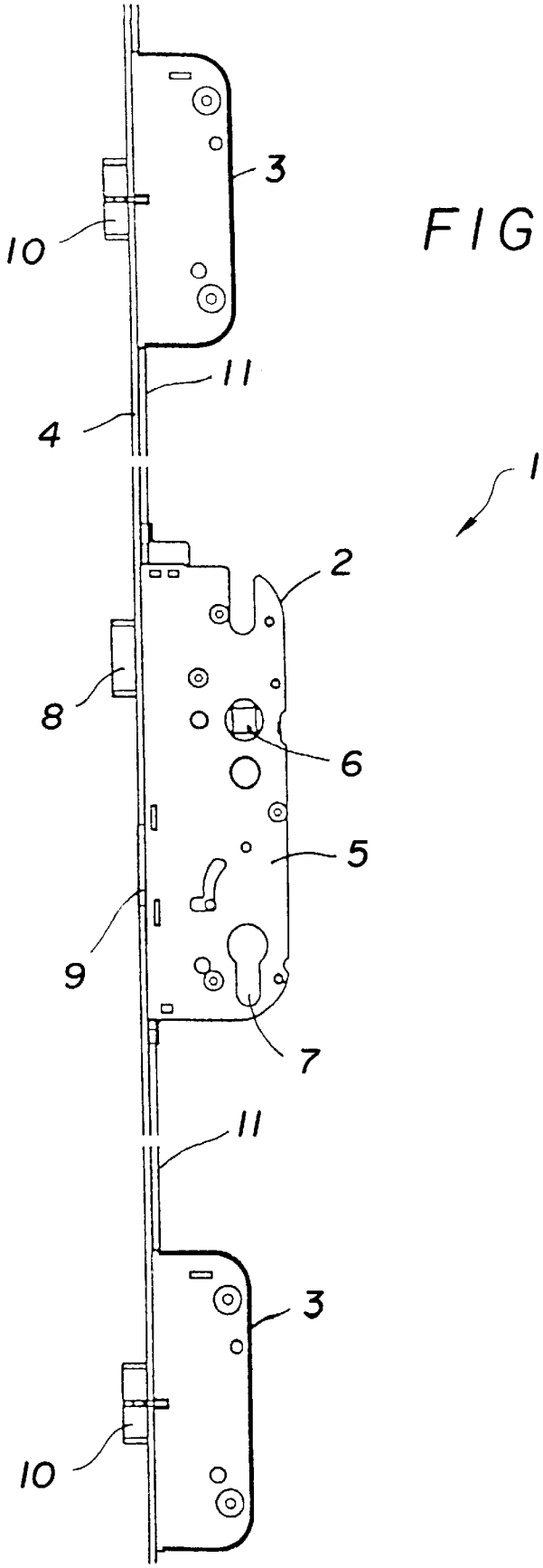
FIG. 1, is a plan view of the embodiment of the locking device in accordance with the present invention, which is composed of a main lock casing and two additional lock casings arranged on both sides, wherein the latches of the lock casings are in the latched position.

The locking device represented in FIG. 1 and identified as a whole by 1 consists of a main lock casing 2 as well as two additional lock casings 3. The lock casings 2 and 3 are fastened on a lock sleeve 4. The main lock casing 2 is closed off by means of a casing cover 5, and a follower 6, a lock cylinder 7, a latch 8 and a main lock bolt 9 can be seen. The latch 8 is in the latched position, so that it can be pushed into the main lock casing 2 by a locking plate 33, represented in FIG. 4 and located on the door frame. The bolt 9 is in the turned back position. The additional lock casings 3 are also respectively provided with a latch, which is embodied as a latch bolt 10. The latch bolts 10 are also in their latched position and therefore can be pushed by a locking plate 33 into the respective additional lock casing 3. Finally, a pushrod 11 can also be seen, which connects the main lock casing 2 with the additional lock casings 3.

Figure 2:
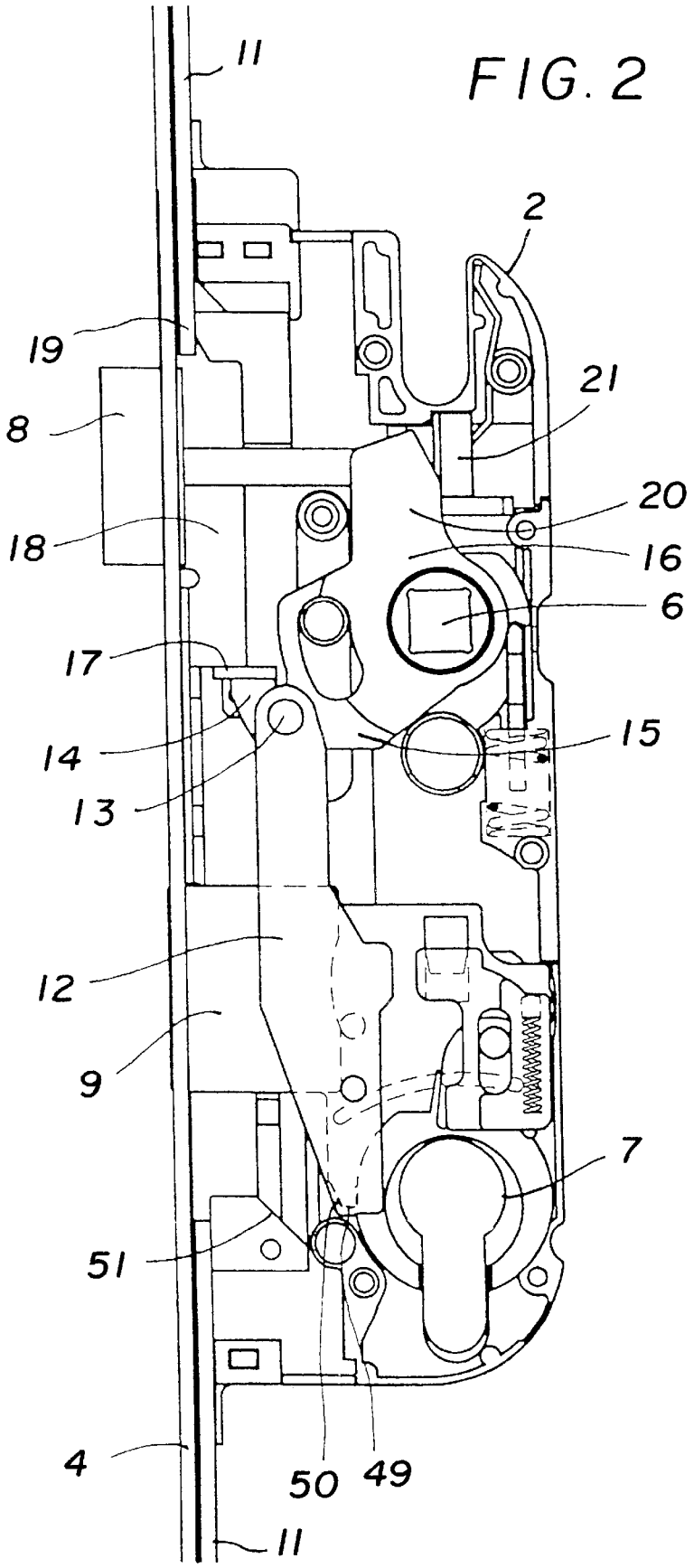
FIG. 2, is a plan view of the main lock casing with the casing cover removed, wherein the bolt is turned back and the latch is in the latched position.

In the plan view of the main lock casing 2 represented in FIG. 2, the casing cover 5 has been removed, so that the locking arrangement can be seen. For example, a changer 12, which can be actuated by the lock cylinder 7 and acts via a bolt 13 on a slide 14 of an arm 15 of a control follower disk 16, is visible. The slide 14 acts on a displacement detent 17 fastened on a control plate 18. The pushrod 11 is suspended in the control plate 18 at 19. The control follower disk 16 has a further arm 20, which rests against a latch foot 21 of the latch 8.

If the changer 12 is actuated via the lock cylinder 7, and the former actuates the control follower disk 16 in a clockwise direction, the latch 8 is retracted into the main lock casing 2 via the arm 20 and the latch foot 21. However, this can also take place in that the follower 6 is actuated in a clockwise direction by means of a latch key, not represented, wherein the follower 6 takes the control follower disk 16 along during its rotating movement. Furthermore, in the course of actuating the lock cylinder 7, or respectively the follower 16, the slide 14, and by means of it the control plate 18, are displaced, by means of which the pushrod is actuated.

The additional lock casing 3 in accordance with FIG. 3 is connected with this pushrod 11. In this lock casing 3, represented without a casing cover, the latch bolt 10 is seated, displaceable in the direction of the section line. In FIGS. 3 and 4, this latch bolt 10 is in the locking position, in which the latch bolt 10 projects past the lock sleeve 4 with its leading incline 22 (FIG. 4) and engages a latch opening 32 of the locking plate 33.

It can furthermore be seen in FIG. 4, that the latch bolt 10 is provided with a groove 23, which is open on one side and extends in its longitudinal direction. A blocking element 24 is located in the groove 23, which is seated, pivotable around a clamping sleeve 25, in the groove 23, and therefore in the latch bolt 10. This blocking element 24 is provided with a blocking protrusion 26 as well as with a triggering protrusion 27.

The spring force for the latch bolt 10 is supplied by a latch push-out spring 28 (FIG. 3), which has been pushed on a spring guide pin 29 and is supported at the one end on the interior of the housing of the additional lock casing 3 and at the other end on a latch push-out lever 30. This latch push-out lever 30 is pivotably seated in a bearing 31. The end of the latch push-out lever 30 located opposite the bearing 31 acts on the end of the blocking element 24 located opposite the triggering protrusion 27 and urges it in the push-out direction by means of the force of the latch push-out spring 28. Since the blocking element 24 is connected with the latch bolt 10 via the clamping sleeve 25, the latter is also urged in the push-out direction.

It can be seen in FIG. 4 that, although the latch push-out lever 30 acts on the blocking element 24, the direction of the force of the latch push-out lever 30 does not pass into the pivot seating of the blocking element 24 constituted by the clamping sleeve 25, so that the latch push-out lever 30 exerts a counterclockwise pivot moment on the blocking element 24. The blocking protrusion 26 as well as the triggering protrusion 27 are lifted out of the groove 23 because of this pivot moment.

When the door is closed, or respectively pushed shut, the latch bolt 10 is pushed over the locking plate 33 (FIG. 4) into the additional lock casing 3.

If the door is in its closed position, and the latch bolt 10 is aligned with the latch opening 32 in the locking plate 33 on the side of the door frame (FIG. 4), the completely pushed in latch bolt 10 is pushed out of the additional lock casing 3 by means of the latch push-out lever 30. In the course of this push-out movement, the blocking element 24 is simultaneously pivoted in a counterclockwise direction around the clamping sleeve 25. In the process, the triggering protrusion 27 comes into contact with the edge of the latch opening 32 of the locking plate 33 facing it, as a result of which the blocking element 24 is pushed against the pivot moment sufficiently far into the groove 23, so that the blocking protrusion 26 can slide past the lock sleeve 4. In this way the locking of the latch bolt 10 in the latch position in accordance with FIG. 1 is prevented, so that the latch bolt 10 can be extended into the locking position represented in FIGS. 3 and 4. In this locking position the latch bolt 10 is extended approximately 10 to 15 mm farther out of the additional lock casing 3 than in the latched position in accordance with FIG. 1.

In a further embodiment, after pivoting of the blocking element 24, the latch push-out lever 30 can rest directly against the latch bolt 10 and move it out into the locking position.

As can be seen from FIG. 3, the latch end 34 has a protrusion 35. It can furthermore be seen, that a latch blocking lever 37 is pivotably seated around a bearing bolt 36 and is spring-loaded in a counterclockwise direction by means of a blocking lever spring 38 embodied as a leg spring. If the latch bolt 10 is in the completely pushed out position in accordance with FIGS. 3 and 4, i.e. in the locking position, then a latch blocking edge 39 extends behind the protrusion 35. Although, as shown in FIG. 3, there can be a slight distance between the protrusion 35 and the latch blocking edge 39, the latch blocking edge 39 extends into the displacement path of the protrusion 35.

If now the latch bolt 10 is pushed into the additional lock casing 3, for example by means of a tool or the like, the protrusion 35 comes to rest against the latch blocking edge 39 and further retraction is prevented. Thus, in its locking position the latch bolt 10 is locked against being pushed in.

If now a latch restoring lever 40, which rests with its one arm 41 against the free end of the pushrod 11, and with its other arm 42 against a further protrusion 43 of the latch end 34, is pivoted by means of the pushrod 11, a protrusion 44 of the free end of the arm 42 acts on a cam 45 of the latch blocking lever 37 (FIG. 3) and lifts it out of the locking position, in which the latch blocking edge 39 extends behind the protrusion 35, sufficiently far so that the latch blocking edge 39 moves out of the displacement path of the protrusion 35. In addition, the arm 42 rests against the protrusion 43 and, in the course of pivoting the latch restoring lever 40, it pulls the latch bolt 10 into the additional lock casing 3. After the latch bolt 10 has been completely pulled into the casing 3, the door can be opened.

With the door open and the pushrod 11 in the position of rest, the latch bolt 10 is pushed out by means of the latch push-out lever 30 until the blocking protrusion 26 extends behind the lock sleeve 4 and prevents it from being pushed out further.

It can be clearly seen in FIG. 3, that the latch restoring lever 40 is provided with a first catch 46 on its free arm 41, by means of which the latch restoring lever 40 is moved by the push rod 11 into the latched position, not represented. In addition, the latch restoring lever 40 has a second catch 47 on its free end, which is formed by a welded-on element 48. The latch restoring lever 40 is pivoted into the locking position by means of the welded-on element 48 in the course of locking the main lock bolt 9 shut, because of which the pushrod 11 is moved downward. Since this is a forced movement, which is only aided by the force of the spring 28, the latch bolt 10 is pushed out in every case.

In the course of locking the main lock bolt 9 shut, an extension 49 of the main lock bolt 9, which has been provided with a bevel 50 on its side facing the pushrod 11, acts against an inclined surface 51 of the pushrod 11 and drives it downward.

What is claimed is:

1. A locking device for a door, window, or the like, comprising:

a main lock casing;

at least one additional lock casing; and at least one pushrod connecting each additional lock casing with said main lock casing, wherein:

each additional lock casing has a retractable latch bolt which defines a latch position and a locking position, biasing means for biasing said retractable latch bolt between its latch position to its locking position, a latch restoring lever and a latch blocking lever, said retractable latch bolt including an inclined leading edge, a protrusion at a latch end located opposite to said leading edge, said latch blocking lever serving to block said retractable latch bolt in its locking position; and said latch restoring lever acted upon by said protrusion, and having a first catch by means of which said pushrod is moved in one direction, and a second catch by means of which said latch restoring lever is moved by said pushrod in a direction opposite to said one direction said latch restoring lever serving to engage said latch blocking lever to unblock said retractable latch bolt in its locking position.

2. The locking device as defined in claim 1, wherein said biasing means comprises a spring.

3. The locking device as defined in claim 1, wherein said second catch comprises an element extending from said latch restoring lever.

4. The locking device as defined in claim 1, wherein said second catch is formed as a welded-on element.

5. The locking device as defined in claim 1, wherein said main lock casing includes a main lock bolt, said main lock bolt having an extension which acts on said pushrod during locking of said main lock bolt.

6. The locking device as defined in claim 1, further comprising:

a latch push-out lever serving to move said retractable latch bolt into its locking position.

* * * * *